US011810206B2

(12) United States Patent
Bassi et al.

(10) Patent No.: US 11,810,206 B2
(45) Date of Patent: Nov. 7, 2023

(54) SOLVER-BASED MEDIA ASSIGNMENT FOR CONTENT MODERATION

(71) Applicant: Microsoft Technology Licensing, LLC, Redmond, WA (US)

(72) Inventors: Neha Bassi, Lucknow (IN); Sandeep Prakash Joshi, Bengaluru (IN); Shashi Kumar, Bihar Sharif (IN); Sachin Kakkar, Bangalore (IN); Gaurav Vashist, Saproon (IN)

(73) Assignee: Microsoft Technology Licensing, LLC, Redmond, WA (US)

( * ) Notice: Subject to any disclaimer, the term of this patent is extended or adjusted under 35 U.S.C. 154(b) by 20 days.

(21) Appl. No.: 17/552,915

(22) Filed: Dec. 16, 2021

(65) Prior Publication Data

US 2023/0196477 A1 Jun. 22, 2023

(51) Int. Cl.
*G06Q 50/00* (2012.01)

(52) U.S. Cl.
CPC ..... *G06Q 50/01* (2013.01)

(58) Field of Classification Search
CPC ..... G06Q 50/01
See application file for complete search history.

(56) References Cited

U.S. PATENT DOCUMENTS 9,760,556 B1 * 9/2017 Knudson ..... G06F 40/134
10,962,939 B1 * 3/2021 Das ..... G06F 16/3344
2011/0258560 A1 * 10/2011 Mercuri ..... G06F 16/958 709/204
2012/0150761 A1 * 6/2012 Ananian ..... G06Q 10/1053 705/321
2015/0254786 A1 * 9/2015 Bank ..... G06Q 50/01 705/7.13
2015/0279221 A1 * 10/2015 Barber ..... G09B 7/00 434/353
2015/0356692 A1 * 12/2015 Shelford ..... G06Q 50/01 705/7.13
2015/0371341 A1 * 12/2015 Iyer ..... H04L 51/52 705/319

(Continued)

OTHER PUBLICATIONS

"Generalized assignment problem", Sep. 6, 2021, 4 pages (retrieved from: https://en.wikipedia.org/wiki/Generalized_assignment_problem on Sep. 30, 2021).

(Continued)

*Primary Examiner* — Florian M Zeender
*Assistant Examiner* — Karma A El-Chanti
(74) *Attorney, Agent, or Firm* — NICHOLSON DE VOS WEBSTER & ELLIOTT LLP

(57) ABSTRACT

Technologies for assigning media moderation tasks are described. Embodiments include receiving media elements, determining a type of a received media element, and receiving active session indications from moderator devices that are connected to a media moderation application. Embodiments include generating a set of assignable moderators based on the active session indications from the moderator devices. Embodiments generate moderator-media assignments based on the active session indications and media types. Embodiments communicate assignment messages to the moderator devices.

18 Claims, 10 Drawing Sheets

(56) References Cited

U.S. PATENT DOCUMENTS

| | | | | |
|---|---|---|---|---|
| 2016/0072918 | A1* | 3/2016 | Gabrelyanov | G06F 16/435 709/219 |
| 2016/0239493 | A1* | 8/2016 | Stroganov | G06F 16/951 |
| 2016/0345066 | A1* | 11/2016 | Barker | H04N 5/77 |
| 2017/0099390 | A1* | 4/2017 | Crowe | H04M 3/5175 |
| 2018/0367508 | A1* | 12/2018 | Huynh | G06F 21/6218 |
| 2020/0202073 | A1* | 6/2020 | Ghulati | G06F 40/279 |
| 2020/0204848 | A1* | 6/2020 | Johnson | H04N 7/188 |
| 2020/0388378 | A1* | 12/2020 | Kartoun | G16H 40/20 |
| 2020/0394588 | A1* | 12/2020 | Sanchez | G06Q 10/063114 |
| 2021/0027884 | A1* | 1/2021 | Wood | A61B 6/5217 |

OTHER PUBLICATIONS

"OptaPlanner User Guide", Jul. 24, 2018, 487 pages (retrieved from: https://docs.optaplanner.org/7.9.0.Final/optaplanner-docs/html_single/index.html#plannerIntroduction on Sep. 30, 2021).

"What is content moderation?" Nov. 20, 2020, 8 pages (retrieved from: https://besedo.com/resources/blog/what-is-content-moderation/ on Sep. 30, 2021).

* cited by examiner

700

SLA Dashboard
Spam Review Queue
Member Review Queue
Ad Review Queue
Job Review Queue

| Content Source | Critical (<15 minutes) | | | | High (< 1 hour) | | | | | |
|---|---|---|---|---|---|---|---|---|---|---|
| | Total | At Risk | Overdue | Regulatory | Total | At Risk | Overdue | Regulatory | Total | At R |
| News Article | - | - | - | - | - | - | - | - | - | |
| Career Pages | - | - | - | - | - | - | - | - | - | |
| Comment | - | - | - | - | - | - | - | - | 30 | |
| Company | - | - | - | - | 1 | - | 1 | - | - | |
| Content Series | - | - | - | - | - | - | - | - | - | |
| Custom Invitation | - | - | - | - | - | - | - | - | - | |
| Event Content | - | - | - | - | - | - | - | - | - | |
| Event Post | - | - | - | - | - | - | - | - | - | |
| Group Definition | - | - | - | - | - | - | - | - | - | |
| Hashtag | - | - | - | - | - | - | - | - | - | |
| Inbox group | - | - | - | - | - | - | - | - | - | |
| Inbox group invitation | - | - | - | - | - | - | - | - | - | |
| Inbox invitation message | - | - | - | - | - | - | - | - | - | |

FIG. 7

SOLVER-BASED MEDIA ASSIGNMENT FOR CONTENT MODERATION

TECHNICAL FIELD

The present disclosure generally relates to content moderation systems, and more specifically, relates to media assignment systems for content moderation.

BACKGROUND

Online platforms, such as social networking sites, receive and distribute massive amounts of user-generated digital content. Content moderation is the process of screening and monitoring user-generated digital content items based on policies and guidelines of a particular online platform to determine whether the digital content items should be published on the online platform. Content moderation is performed using teams of human moderators who manually review digital content items.

BRIEF DESCRIPTION OF THE DRAWINGS

The disclosure will be understood more fully from the detailed description given below and from the accompanying drawings of various embodiments of the disclosure. The drawings, however, should not be taken to limit the disclosure to the specific embodiments, but are for explanation and understanding only.

FIG. 7 is a prior art example of a prior art user interface for media assignment.

DETAILED DESCRIPTION

Figure 1:
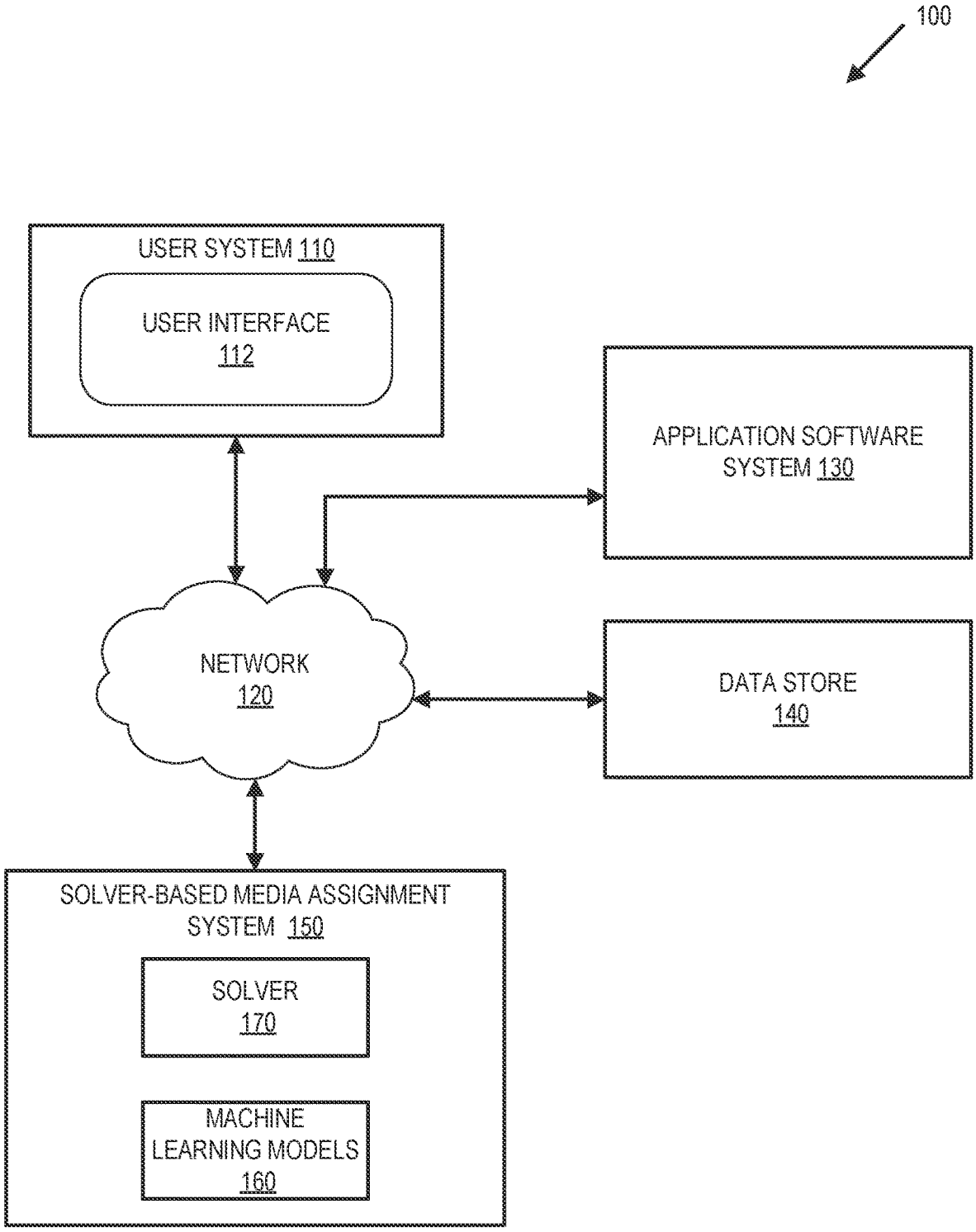
FIG. 1 illustrates a computing system that includes a solver-based media assignment system in accordance with some embodiments of the present disclosure.

Moderation of digital content on a distributed online platform presented in multiple different geographic regions and multiple different languages around the world presents challenges of scale and completion time requirements. As the quantity of digital content increases on the distributed online platform, the requirements for content moderation similarly increase.

Existing media assignment systems have not been able to scale appropriately as the quantity and types of user-generated content continue to proliferate. In existing content moderation systems, the processes by which digital content items are assigned to human reviewers have become tedious, labor-intensive and error prone.

Existing content moderation systems are limited in the ways in which the assignment and prioritization of content moderation tasks can be performed. Additionally, existing content moderation systems require users to perform many of the assignment and prioritization tasks manually, which causes significant delays or errors as the number of assignment and prioritization tasks increases and becomes overwhelming. Delays and errors in the assignment and prioritization of content moderation tasks makes it increasingly difficult for the content moderators ultimately assigned to those content moderation tasks to moderate the content properly.

For example, existing systems require a supervising user to identify content items that have been flagged for review, search for reviewers, and assign the flagged content items to reviewers through a crowded and confusing user interface such as the example shown in FIG. 7.

Existing systems do not automatically assign content moderation tasks to moderators and do not automatically determine the availability of moderators. Consequently, if a supervising reviewer makes an error, a moderation task may stagnate or be assigned to an unavailable moderator.

Aspects of the present disclosure address the above and other deficiencies by providing a solver-based approach to media assignment for content moderation. Media as used herein can refer to any type of digital content, including text, recorded video, streaming video, recorded audio, streaming audio, graphics, images, or any combination of any of the foregoing.

Embodiments periodically formulate and execute assignment jobs that gather data about then-currently available moderator devices and then-currently pending content moderation tasks. Embodiments apply an optimization solver to the data gathered by the then-current assignment job. The optimization solver outputs a mapping of the then-currently available moderator devices to the then-currently pending content moderation tasks. Based on the mapping produced by the optimization solver, embodiments distribute assignment messages to the then-currently available moderator devices. The assignment jobs and the time intervals at which they are re-run can be customized for different particular types of media and/or for different types of content moderation tasks.

FIG. 1 illustrates an example of a computing system 100 that includes a solver-based media assignment system 150 in accordance with some embodiments of the present disclosure.

Computing system 100 includes a user system 110, a network 120, an application software system 130, a data store 140, a solver-based media assignment system 150, machine learning models 160, and solver 170.

User system 110 includes at least one computing device, such as a personal computing device, a server, a mobile computing device, or a smart appliance. User system 110 includes at least one software application, including a user interface 112, installed on or accessible by a network to a computing device. For example, user interface 112 can be or include a front-end portion of application software system 130.

User interface 112 is any type of user interface as described above. User interface 112 can be used to input search queries and view or otherwise perceive output that includes data produced by application software system 130. For example, user interface 112 can include a graphical user interface and/or a conversational voice/speech interface that includes a mechanism for entering a search query and viewing query results and/or other digital content. Examples of user interface 112 include web browsers, command line interfaces, and mobile apps. User interface 112 as used herein can include application programming interfaces (APIs). In some embodiments, the user interface 112 can be configured to receive input from a user and present data to the user. The user interface 112 can receive inputs, such as from a user input device (not shown). For example, the user interface 112 can present data to the user requesting input, such as a moderation action. The user interface 112 can present various media elements to the user including audio, video, image, haptic, or other media data.

Data store 140 is a memory storage. Data store 140 stores moderator data, media element attributes, and moderation task attributes. Data store 140 can reside on at least one persistent and/or volatile storage device that can reside within the same local network as at least one other device of computing system 100 and/or in a network that is remote relative to at least one other device of computing system 100. Thus, although depicted as being included in computing system 100, portions of data store 140 can be part of computing system 100 or accessed by computing system 100 over a network, such as network 120. For example, data store 140 can be part of a data storage system that includes multiple different types of data storage and/or a distributed data service. As used herein, data service may refer to a physical, geographic grouping of machines, a logical grouping of machines, or a single machine. For example, a data service may be a data center, a cluster, a group of clusters, or a machine.

Application software system 130 is any type of application software system that includes or utilizes functionality provided by solver-based media assignment system 150. Examples of application software system 130 include but are not limited to connections network software, such as social media platforms, and systems that are or are not based on connections network software, such as general-purpose search engines, job search software, recruiter search software, sales assistance software, advertising software, learning and education software, or any combination of any of the foregoing.

While not specifically shown, it should be understood that any of user system 110, application software system 130, data store 140, solver-based media assignment system 150, and machine learning models 160 can include an interface embodied as computer programming code stored in computer memory that when executed causes a computing device to enable bidirectional communication with any other of user system 110, application software system 130, data store 140, solver-based media assignment system 150, and machine learning models 160 using a communicative coupling mechanism. Examples of communicative coupling mechanisms include network interfaces, inter-process communication (IPC) interfaces and application program interfaces (APIs).

A client portion of application software system 130 can operate in user system 110, for example as a plugin or widget in a graphical user interface of a software application or as a web browser executing user interface 112. In an embodiment, a web browser can transmit an HTTP request over a network (e.g., the Internet) in response to user input that is received through a user interface provided by the web application and displayed through the web browser. A server running application software system 130 and/or a server portion of application software system 130 can receive the input, perform at least one operation using the input, and return output using an HTTP response that the web browser receives and processes.

Each of user system 110, application software system 130, data store 140, solver-based media assignment system 150, and machine learning models 160 is implemented using at least one computing device that is communicatively coupled to electronic communications network 120. Any of user system 110, application software system 130, data store 140, solver-based media assignment system 150, and machine learning models 160 can be bidirectionally communicatively coupled by network 120. User system 110 as well as one or more different user systems (not shown) can be bidirectionally communicatively coupled to application software system 130.

A typical user of user system 110 can be an administrator or end user of application software system 130, solver-based media assignment system 150, and/or machine learning models 160. User system 110 is configured to communicate bidirectionally with any of application software system 130, data store 140, solver-based media assignment system 150, and/or machine learning models 160 over network 120.

The features and functionality of user system 110, application software system 130, data store 140, solver-based media assignment system 150, and machine learning models 160 are implemented using computer software, hardware, or software and hardware, and can include combinations of automated functionality, data structures, and digital data, which are represented schematically in the figures. User system 110, application software system 130, data store 140, solver-based media assignment system 150, and machine learning models 160 are shown as separate elements in FIG. 1 for ease of discussion but the illustration is not meant to imply that separation of these elements is required. The illustrated systems, services, and data stores (or their functionality) can be divided over any number of physical systems, including a single physical computer system, and can communicate with each other in any appropriate manner.

Network 120 can be implemented on any medium or mechanism that provides for the exchange of data, signals, and/or instructions between the various components of computing system 100. Examples of network 120 include, without limitation, a Local Area Network (LAN), a Wide Area Network (WAN), an Ethernet network or the Internet, or at least one terrestrial, satellite or wireless link, or a combination of any number of different networks and/or communication links.

Figure 10:
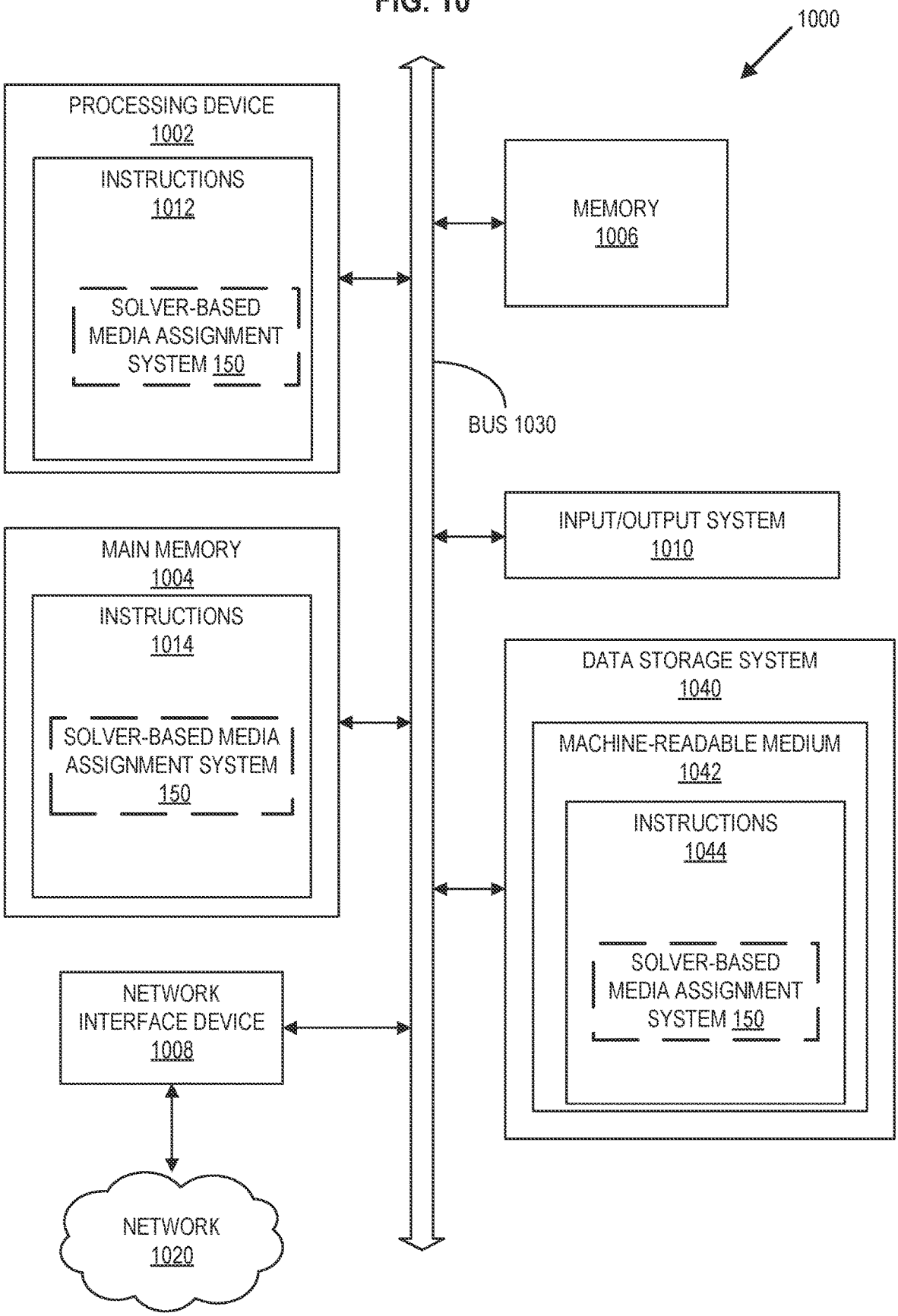
FIG. 10 is a block diagram of an example computer system for implementing a solver-based media assignment system in accordance with some aspects of the present disclosure.

The computing system 100 includes a solver-based media assignment system 150 that applies machine learning models 160 and solver 170 to provide skill and attribute-based routing of media moderation tasks. In some embodiments, the application software system 130 includes at least a portion of the machine learning models 160. As shown in FIG. 10, the solver-based media assignment system 150 can be implemented as instructions stored in a memory, and a processing device 1002 can be configured to execute the instructions stored in the memory to perform the operations described herein.

The solver-based media assignment system 150 can provide a distributed and dynamically configurable media assignment service for content moderation tasks. While solver-based media assignment system 150 is described as an executable application, in some embodiments, the solver-based media assignment system 150 may be implemented in specialized hardware or as a cloud Software or as a Service (SaaS) application. The disclosed technologies are described with reference to an example use case of digital content moderation; for example, controlling media content provided by a content server, such as a professional social network application that provides content to a broad based of users in multiple geographic locations. The disclosed technologies are not limited to social graph applications but can be used to perform skill and attribute-based content moderation task assignment more generally. The disclosed technologies can be used by many different types of network-based applications in which digital or analog media content is processed by one or more reviewing or approval entities.

The solver-based media assignment system 150 can include machine learning models 160. Some embodiments of machine learning models 160 include one or more trained machine learning models for classifying media elements and determining a set of inputs for the solver 170.

The solver-based media assignment system 150 can include the solver 170 to perform assignments of media moderation tasks, in some embodiments. For instance, the solver 170 can be a constraint solver that generates an assignment of moderation tasks by performing an optimization by applying an optimization function to the input values such as, but not limited to content category, severity, moderator availability, moderator location, a queue length, a service level agreement, or other factors. In operation, the solver receives one or more of these input values from the data store 140 or from the machine learning models 160. In one example, the solver 170 maximizes or minimizes a real function by choosing input values from a set of potential input values and computing the value of the optimization function. The solver 170 optimizes assignments of media elements and moderator profiles based on a set of required rules and a set of preferred rules, in some embodiments. The solver 170 determines the optimization based on maximizing compliance with a number of required rules (e.g., service level agreement, moderator availability, etc.) and a compliance with a number of preferred rules (e.g., moderator location, moderator language proficiency, etc.), in some embodiments. As described in more detail below, embodiments of the solver 170 matches an available moderator to a content moderation task associated with a particular media element.

The machine learning models 160 include a trained classifier that provides a classification of an input media element by determining a category, severity, or other features of the media element, in some embodiments. The machine learning models 160 extract content, metadata, or other features from the input media element to determine the category or severity of the media element, in some embodiments. Examples of categories include copyright violations, violent content, adult content, or other sensitive content. The machine learning models 160 provides model output such as the category or severity of the media element, which can be used by the solver 170 as an input to the optimization function.

In another example, the machine learning models 160 determines a similarity between a selected media element and a selected moderator based on one or more features of the media element and one or more attributes of the moderator profile. For instance, the media element can have content in Latin and a moderator can have a proficiency attribute of Latin language. In another example, the media element can include a technical concept (e.g., electronics, security systems, etc.) that may be misused in the media element. The machine learning models 160 can determine that a moderator with a technical background attribute of electronics or software is needed to moderate the media element. Any number of features of the media element and attributes of the moderator profile may be used to perform the matching of a moderator to a media element. In some cases, the moderator profile includes a moderation history attribute (e.g., historical moderations) that indicates previously moderated media elements and an indication of task completion. In some embodiments, the machine learning models 160 use the moderation history to apply a weight to the features and profile attributes based on historically significant matches.

Further details with regards to the operations of the solver-based media assignment system 150 and machine learning models 160 are described below.

Figure 2:
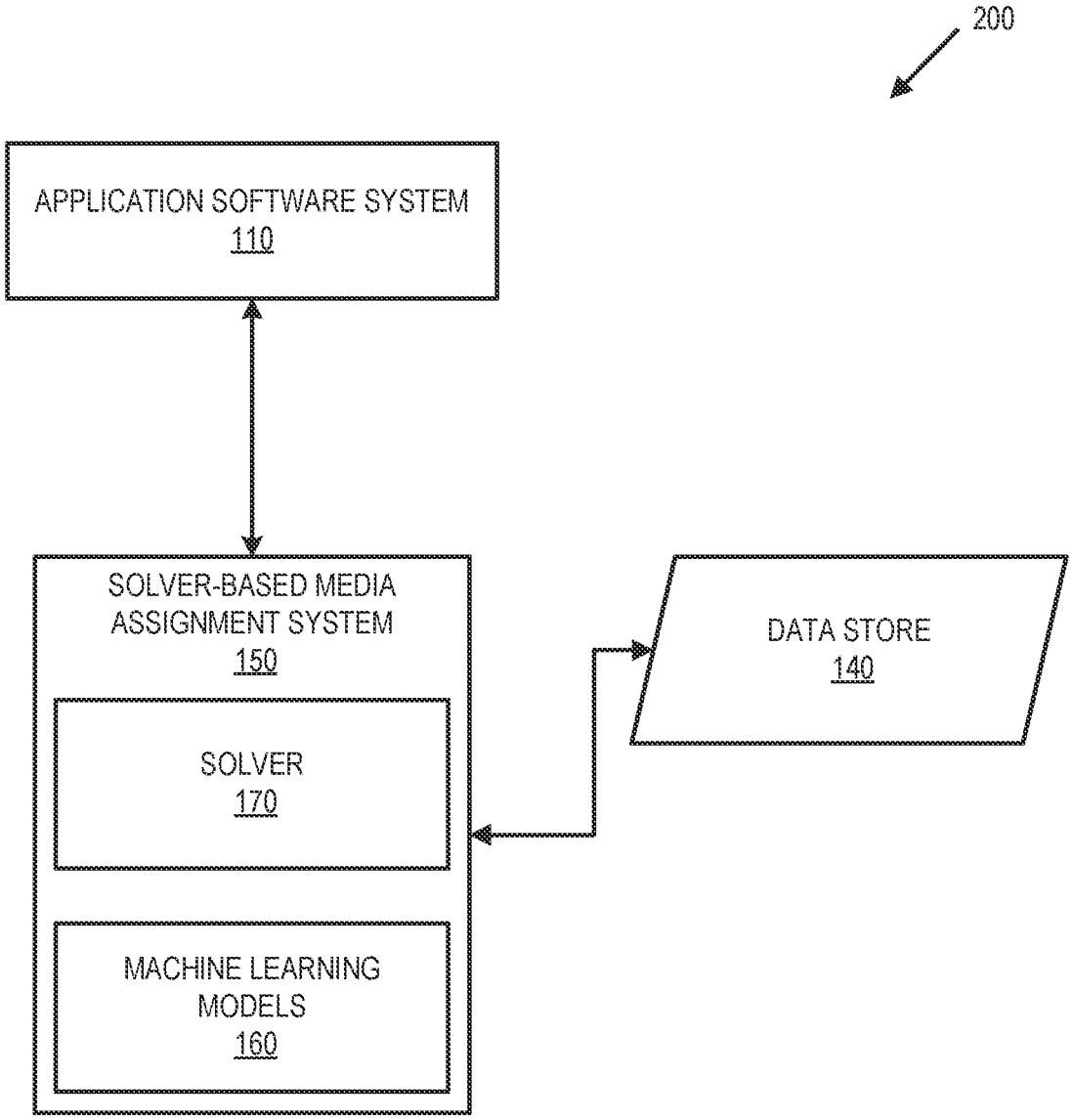
FIG. 2 is an example of inter-component flows for solver-based media assignment in accordance with some embodiments of the present disclosure.

FIG. 2 is an example of inter-component flows for solver-based media assignment in accordance with some embodiments of the present disclosure.

Embodiments of the application software system 130 can provide a content serving platform to a user via a network interface. For example, the application software system 130 receives media elements from users, other content platforms, or other computing devices. The application software system 130 receives feedback from users, such as by a user interaction with a user interface presented by the application software system 130 such as in a browser or by a mobile device application. Embodiments of the application software system 130 communicate the content, feedback, or associated data to the solver-based media assignment system 150.

The solver-based media assignment system 150 receives content, feedback, or associated data ("input data") from the application software system 130, in some embodiments. The solver-based media assignment system 150 stores persistent records of the input data in data store 140, for example. In some embodiments, solver-based media assignment system 150 provides portions of the input data to the machine learning models 160. In some embodiments, the solver-based media assignment system 150 processes a subset of input data with one or more machine learning models 160, such as a classifier or a sensitivity prediction model.

In some embodiments, the solver-based media assignment system 150 includes a social listening engine that can monitor trend information about media elements on the application software system 130. In some examples, the social listening engine determines a frequency or trend line information of similar media elements. The social listening engine determines that a specific media element, or multiple media elements having a similarity that exceeds a threshold are occurring with an increasing frequency, in some examples. The social listening engine flags the media element attributes with a frequency indicator, in some embodiments.

The solver-based media assignment system 150 uses the frequency indicator to determine a priority for a moderation task associated with the media element (or similar media elements), in some embodiments. In one example, the social listening engine determines that a particular media element is occurring with a frequency that exceeds a threshold (or a rate of increase exceeds a threshold) and generate a frequency indicator. The solver-based media assignment system 150 increases the prioritization of moderation tasks associated with media elements based on an order of frequency indicator (e.g., from highest to lowest value, etc.).

The machine learning models 160 include multiple machine learning models for processing the input data as well as moderator profile data from data store 140, in some embodiments. In one example, the machine learning models 160 classify a media element received from application software system 130. The machine learning models 160 classify the media element into one or more categories based on a type of file, a size of the file, an extraction of text (e.g., text recognition in the image or caption information), a profile of a user who posted the media element, or additional factors, in some examples. The machine learning models 160 assign category information to the media element using one or more media element attributes, in some examples. The machine learning models 160 determine, based on the one or more categories, a prioritization of a moderation task for the media element, in some examples. The machine learning models 160 provide the category information to the solver-based media assignment system 150 or the solver 170 for additional processing, in some examples. The machine learning models 160 store the category or media element attributes in data store 140, in some examples.

The solver-based media assignment system 150 determines prospective moderators based on the categories and additional media element attributes. In one example, the solver-based media assignment system 150 determines a language, a geographical region, or a technical field associated with the media element. In some cases, the solver-based media assignment system 150 determines that a moderator lacks sufficient proficiency to complete one or more assigned moderation tasks. In one example, the solver-based media assignment system 150 determines that the moderator proficiency is not sufficient due to a new type (e.g., category or severity) of tasks assigned to the moderator. For instance, the solver-based media assignment system 150 determines from the moderator profile that the moderator is below a threshold experience level with regard to specific types of media elements. As a result, the solver-based media assignment system 150 excludes the media element from assignment to the moderator.

In another example, the solver-based media assignment system 150 additionally or alternatively receives a request to remove a media element assignment from a moderator from the moderator via the moderator's user interface. In this example, the solver-based media assignment system 150 includes, on the moderator user interface, a prompt that enables a manual exclusion for types of media elements, or for a specific media element that has previously been assigned to the moderator. The solver-based media assignment system 150 updates the moderator profile based on the input received through the moderator interface to adjust the matching of the moderator with similar types of media elements. The solver-based media assignment system 150 applies one or more attribute tags to the moderator profile or the media element, such as topic, task type, legal policies, average handling time, etc. The solver-based media assignment system 150 store these attributes to be utilized for subsequent assignments.

Figure 3:
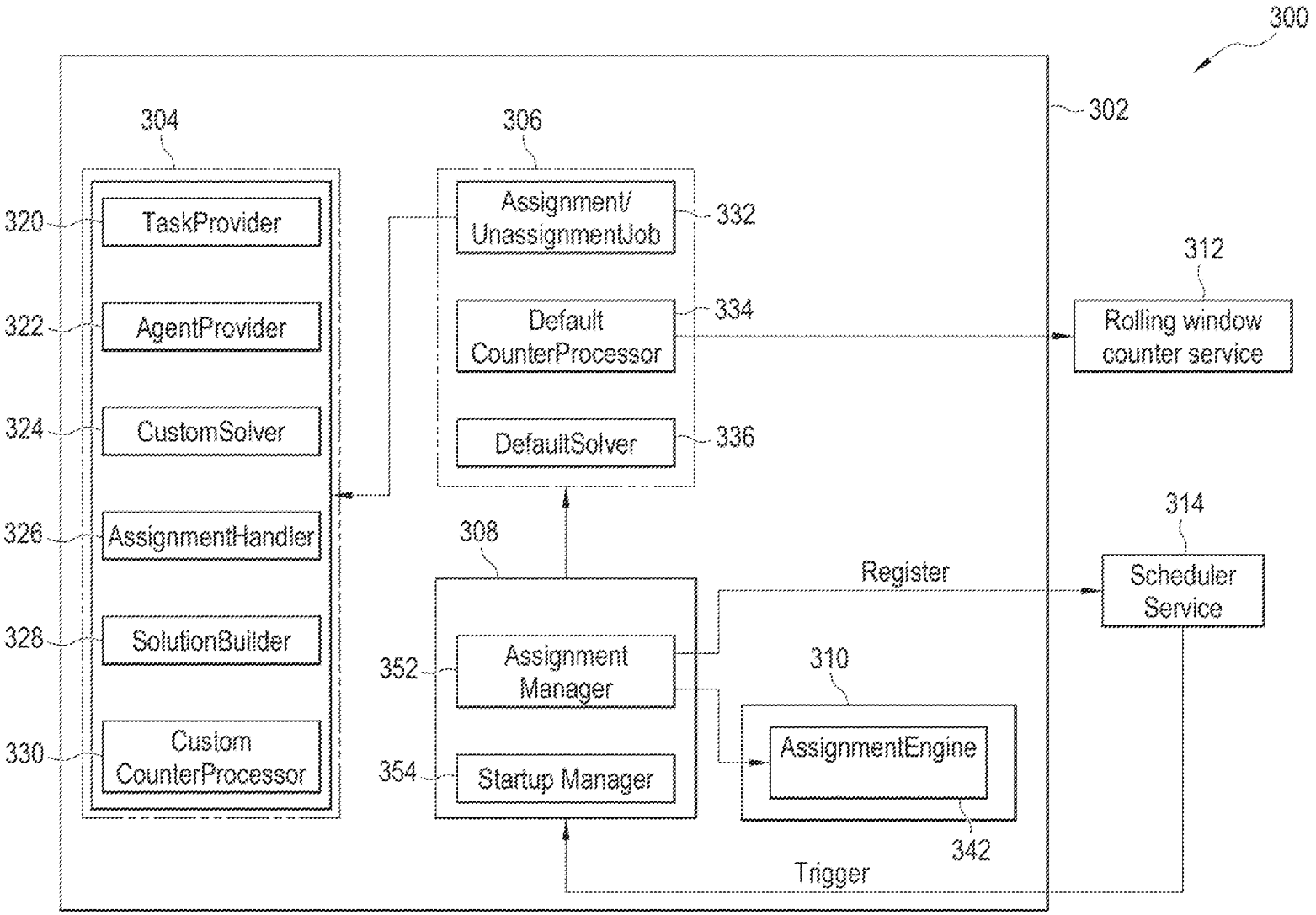
FIG. 3 is an example of media task assignment flows for solver-based media assignment in accordance with some embodiments of the present disclosure.

FIG. 3 is an example of a solver-based media assignment system 150 in accordance with some embodiments of the present disclosure. For instance, portions of the solver-based media assignment system 150 are implemented as one or more software applications and/or specialized hardware. The solver-based media assignment system 150 includes a strategy provider 304, a core manager 306, a core monitor 308, an assignment storage 310, a rolling window counter service 312, and a scheduler service 314.

The illustrated embodiment of strategy provider 304 includes task provider 320, agent provider 322, custom solver 32, assignment handler 326, solution builder 328, and custom counter processor 330. In one example, task provider 320 is a service for providing tasks for an end user. The task provider 320 defines tasks that include a task and a file such as a Rake task and the file pointer for the location containing the task. The Agent provider 322 monitors and collects a set of available agents and a profile associated with each available agent.

The custom solver 324 is a constraint solver that generates an assignment of moderation tasks to moderator devices by applying an optimization function to input values selected from the data store or the machine learning models. In one example, the custom solver 324 maximizes or minimizes a real function by choosing input values from a set of potential input values and computing the value of the optimization function. The custom solver 324 outputs a set of solutions based on a threshold compliance with the set of required rules and the set of preferred rules.

For instance, the custom solver 324 generates a first output solution for a set of input values for which no 100% satisfaction of the set of required rules can be computed. In this example, the custom solver 324 applies a prioritization to each required rule in the set of required rules such that multiple output solutions are computed to determine a maximum number of required rules that can be satisfied by adjusting the set of required rules. In an example, the custom solver 324 adjusts a compliance requirement for a language proficiency so that a service level agreement associated with a type of the content item (e.g., violence, suicide, etc.) can be achieved. The custom solver 324 thus provides a flexible optimization that can produce assignments that comply with a large number of required rules. Embodiments of the custom solver 324 implements prioritization of compliance which enables the solver to continue to perform even in high task density scenarios or to compensate for moderator unavailability. Embodiments of the custom solver 324 are configured with additional inputs based on a desired information set, such as coupling multiple content systems for incoming tasks. In some embodiments, the custom solver 324 transitions a selected rule from a required rule to a preferred rule based on availability of moderators or a number of tasks to be assigned. In one example, the custom solver 324 determines that a moderation task is associated with a required rule that limits moderators based on a language proficiency (i.e., required rule for moderator to be proficient in Portuguese). The custom solver 324 determines that a moderator with a Portuguese language attribute is not available. The custom solver 324 transitions the required rule of language proficiency to a preferred rule and assigns the moderation task. The custom solver 324 transitions the preferred rule of language proficiency back to a required rule when the moderator with a Portuguese language attribute is available.

The assignment handler 326 provides automated grouping of available moderators and tracks availability, capacity, and available skills of moderators. For example, the assignment handler 326 tracks a task assignment to prevent the same task from being assigned to multiple moderators. The assignment handler 326 monitors activity of an individual moderator with regard to an assigned task. For instance, the assignment handler 326 flags a task for reassignment after a moderator is idle for a predetermined time interval. The custom solver 324 receives the flag and generates a new assignment for the task associated with the flag. In some embodiments, the assignment handler 326 receives a request from the moderator, via the user interface, to retain the task. For example, the moderator determines that the task is likely to include additional time that is greater than the average handling time to complete a task due to one or more reasons. The moderator determines that the task requires additional due diligence to complete or that certain aspects of the task are not clearly understood by the moderator. The request by the moderator to retain the task for a time greater than the average handling time provides the moderator additional time to complete the task.

The solution builder 328 is a bundling component that creates an object including all moderators, moderator profiles, tasks, task assignments, and other information. The solution builder 328 can provide this object to other computing systems such as analytics, diagnostics, and developer environments.

The custom counter processor 330 is a customizable counter that can be configured to count tasks assigned to moderators and aggregate the counting over any time interval. The custom counter processor 330 dynamically adjusts the time interval based on a rate of incoming tasks, a total number of tasks, or other factors. In one example, the custom counter processor 330 counts a specific type of task, such as a severely violent content item, to prevent a moderator from receiving a quantity of severe content that is greater than a threshold. In this example, the custom counter processor 330 can identify when the moderator has accumulated the threshold quantity of severe tasks and prevent the custom solver 324 from assigning the moderator additional severe tasks.

The core manager 306 includes assignment/unassignment job 332, default counter processor 334, and a default solver 336. The core manager 306 provides assignment/unassignment job 332 to the strategy provider 304. The core manager 306 provides back-end monitoring of the strategy provider 304.

The default counter processor 334 is a counter that configured to count tasks assigned to moderators and aggregate the counting over a time dimension. The default counter processor 334 counts total tasks assigned to a moderator or a quantity of tasks for a particular type of task. The default counter processor 334 provides a pre-determined prioritization and defined sets of required rules and preferred rules.

The default solver 336 is a constraint solver that generates an assignment of moderation tasks to moderators by applying an optimization to input values selected from the data store and/or output of the machine learning models. In one example, the default solver 336 maximizes or minimizes a real function by choosing a predetermined set of input values from a set of potential input values and computing the value of the optimization function. In some embodiments, the default solver 336 can correspond to the solver 170.

The core monitor 308 monitors the core manager 306 for system health, computing resources allocated, rate of task assignment or completion, and the like. The core monitor 308 performs system health checks on a pre-determined or dynamic time interval such that the core manager 306 and strategy provider 304 are continuously providing task assignment of incoming tasks to available moderators. The core monitor 308 includes assignment manager 352 and startup manager 354. The assignment manager 352 monitors task assignments to ensure that a single task is assigned to a single moderator on one or more devices associated with one or more authenticated sessions of the moderator. The assignment manager 352 outputs sets of one or more assignments and a status associated with the assignment. The startup manager 354 initializes additional computing resources, restarts an assignment process, or recovers core manager 306 and strategy provider 304 in the event of a system health degradation.

The assignment storage 310 stores assignments from the assignment manager 352. The assignment storage 310 includes an assignment engine 342 that stores an initial set of task assignments.

The rolling window counter service 312 counts and preserves a time interval based on an assignment event. For example, a rolling window can be expressed relative to the event date and automatically shift forward corresponding to a passage of time. For instance, a moderator with a 5-year rolling window who gets a task assigned on May 4, 2015 would receive data (content to review) covering the period from May 4, 2015 to May 4, 2020. The scheduler service 314 is a schedule controller that schedules computing jobs, such as running an assignment generation job or updating task status.

Figure 4:
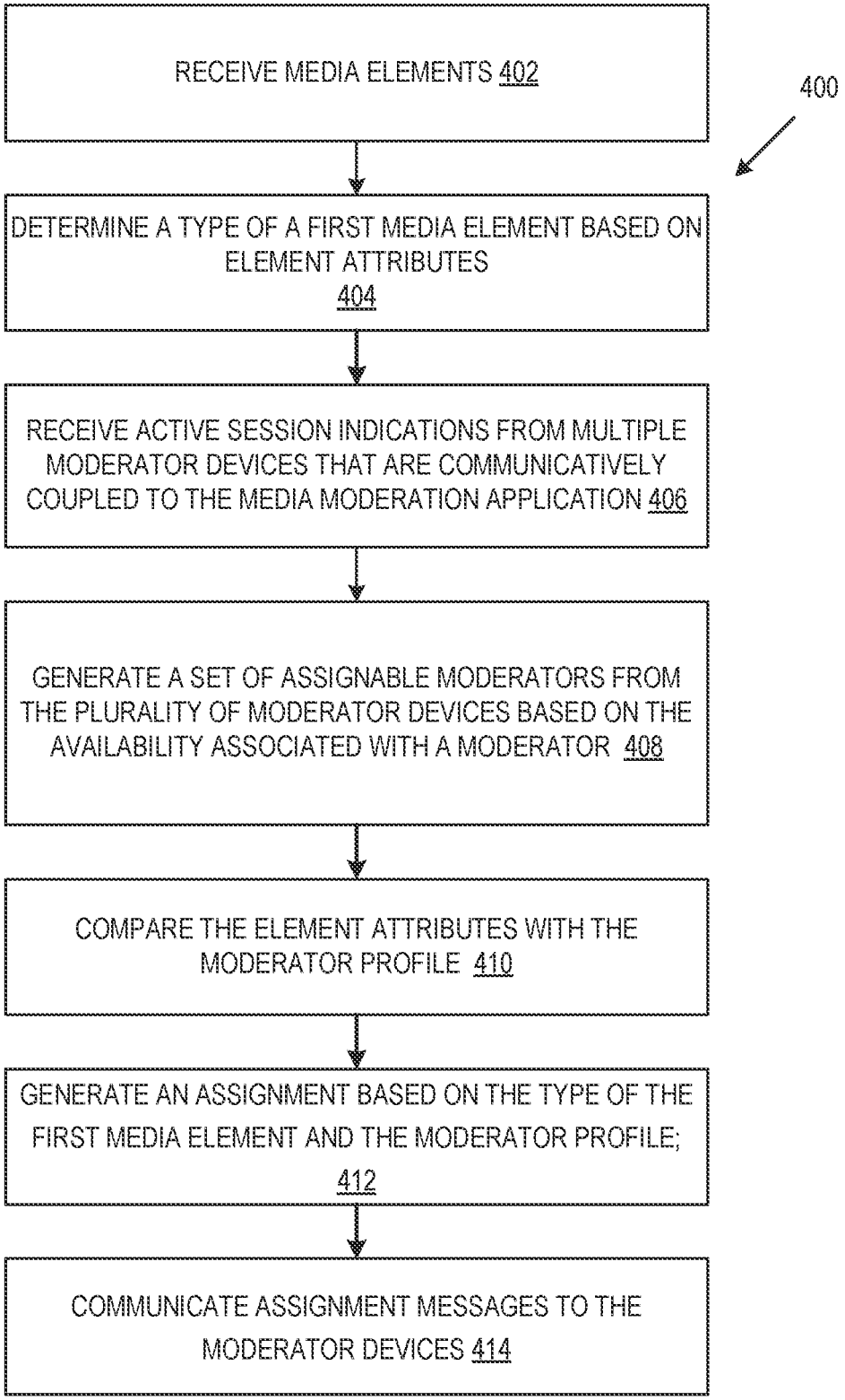
FIG. 4 is a flow diagram of an example method of solver-based media assignment in accordance with some embodiments of the present disclosure.

FIG. 4 is a flow diagram of an example method 400 of solver-based media assignment in accordance with some embodiments of the present disclosure.

The method 400 is performed by processing logic that can include hardware (e.g., processing device, circuitry, dedicated logic, programmable logic, microcode, hardware of a device, integrated circuit, etc.), software (e.g., instructions run or executed on a processing device), or a combination thereof. In some embodiments, the method 300 is performed by portions of the solver-based media assignment system 150 of FIG. 1.

Although shown in a particular sequence or order, unless otherwise specified, the order of the processes can be modified. Thus, the illustrated embodiments should be understood only as examples, and the illustrated processes can be performed in a different order, and some processes can be performed in parallel. Additionally, one or more processes can be omitted in various embodiments. Thus, not all processes are required in every embodiment. Other process flows are possible.

At operation 402, the processing device receives media elements. For example, a media moderation application receives media elements from the application software system 130 via any communicative coupling mechanisms include network interfaces, inter-process communication (IPC) interfaces and application program interfaces (APIs).

At operation 404, the processing device determines a type of a media element based on element attributes. The processing device determines a type of the media element using one or more machine learning models as described above. Additionally or alternatively, the processing device receives type information from a user of the application software system, such as by a user interface. In some embodiments, the user provides category information that indicates a type of the media element.

At operation 406, the processing device receives active session indications from multiple moderator devices; for example, moderator devices that are communicatively coupled to a media moderation application or to a media assignment application. For example, a media moderation application or media assignment application may communicate with multiple moderator devices. The processing device receives, via a user interface of a moderator device, an indication of an activity status for that moderator.

In other embodiments, the processing device determines an inactivity of a moderator based on a length of an elapsed time interval between inputs or moderation task completions at a moderator device. In some embodiments, the processing device generates a prompt to present a required response time interval to an active moderator that has not responded within a portion of the time interval for inactivity. In other examples, the processing device determines that an active moderator has exceeded a threshold of moderation tasks or a severity threshold of sensitive tasks. processing device adjusts the active status of moderators to an inactive status in response to determining that the active moderator has exceeded various thresholds, such as, but not limited to the thresholds discussed above.

At operation 408 the processing device generates a set of assignable moderators from the multiple moderator devices based on the availability data associated with the moderators based on the corresponding moderator profiles. For example, the processing device generates a list or other data structure that identifies moderators that are active as determined at operation 406. The processing device stores a list of active moderators in the data store.

At operation 410 the processing device compares the element attributes with the moderator profile. The processing device determines a match between one or more media elements and one or more moderators. In one example, the processing device computes a similarity score between a media element and a moderator. The processing device determines that a particular media element corresponds to a particular language (e.g., English, Spanish, Korean, Mandarin, etc.) and that a particular moderator profile has a proficiency attribute associated with the particular language. The processing device compares a response time or average task completion time of the moderator profile to a required completion time associated with the media element (e.g., a service level agreement).

At operation 412 the processing device generates an assignment based on the type of the media element and the moderator profile. The processing device assigns the media element to the moderator, such as described above with regard to the solver-based media assignment system 150. The processing device allocates one or more batches of moderation tasks to the assigned moderator. The processing device prioritizes shorter required completion times, rare language or technical knowledge requirements, or rapidly increasing visibility metrics (i.e., as determined by the social listening engine). The processing device adjusts media/moderator assignments on a periodic or continuous basis.

In one example, the processing device is configured with adjustable assignment priorities. The processing device adjusts one or more assignment rules or match requirements between a media element and the moderator profile. The processing device determines a set of required rules that must be met prior to assigning a moderator to a media element. Examples of a required rule include a required completion time, a seniority level of the moderator, and a geographic location of the moderator (e.g., a location specific task, jurisdictional rule, etc.). The processing device determines a set of preferred rules that are to be met prior to assigning a moderator a media element. Examples of preferred rules include a language proficiency, a technical proficiency, a region of the moderator, or demographic data of the moderator.

In some embodiments, the processing device applies a weight to the preferred rules during an assignment of a media element to a moderator. For instance, the processing device adapts the preferred rules in response to the moderator and required rules. The processing device successfully assigns a media moderation task to a moderator based on determining that all required rules are satisfied and that a threshold number of the preferred rules are satisfied. The processing device prioritizes both required and preferred rules, in some cases, such as a surge mode in which there is a sudden increase in media elements being received for moderation. In these examples, the processing device selects a critical set of required rules, such as a required completion time or a seniority requirement, which remain required, with other required rules being adjusted from being required to preferred during the surge mode. The media moderation application can return to satisfying all required rules after the surge mode is ended (e.g., the rate of media elements received decreases below a surge threshold).

In one example, the processing device assigns a routine moderation task of a first media element that has a low sensitivity and a lengthy required completion time (e.g., 1 day) to a first moderator from the list of assignable moderators. Prior to the assigned moderator initiating the moderation task on the first media element, the processing device assigns a second media element that has an urgent priority (e.g., 15 minutes) and high sensitivity media element to the first moderator. The processing device provides a notification to the first moderator to start the moderation task for the second media element prior to starting the moderation task for the first media element. In some examples, the processing device reassigns the first media element to a different moderator.

At operation 414 the processing device communicates assignment messages to the moderator devices. For example, the processing device transmits assignment messages to the user interface at the moderator devices via any communicative coupling mechanisms include network interfaces, inter-process communication (IPC) interfaces and application program interfaces (APIs). In one example, the assignment messages include a set of media elements and a priority for each media element. The priority can be based on a criticality of a particular rule such as service level agreement, or a language requirement. The assignment messages can also or alternatively populate in a user interface of the application software system. The assignment messages can additionally include a sensitivity metric, category information, an estimated completion time, or a required completion time for each moderation task.

Figure 5:
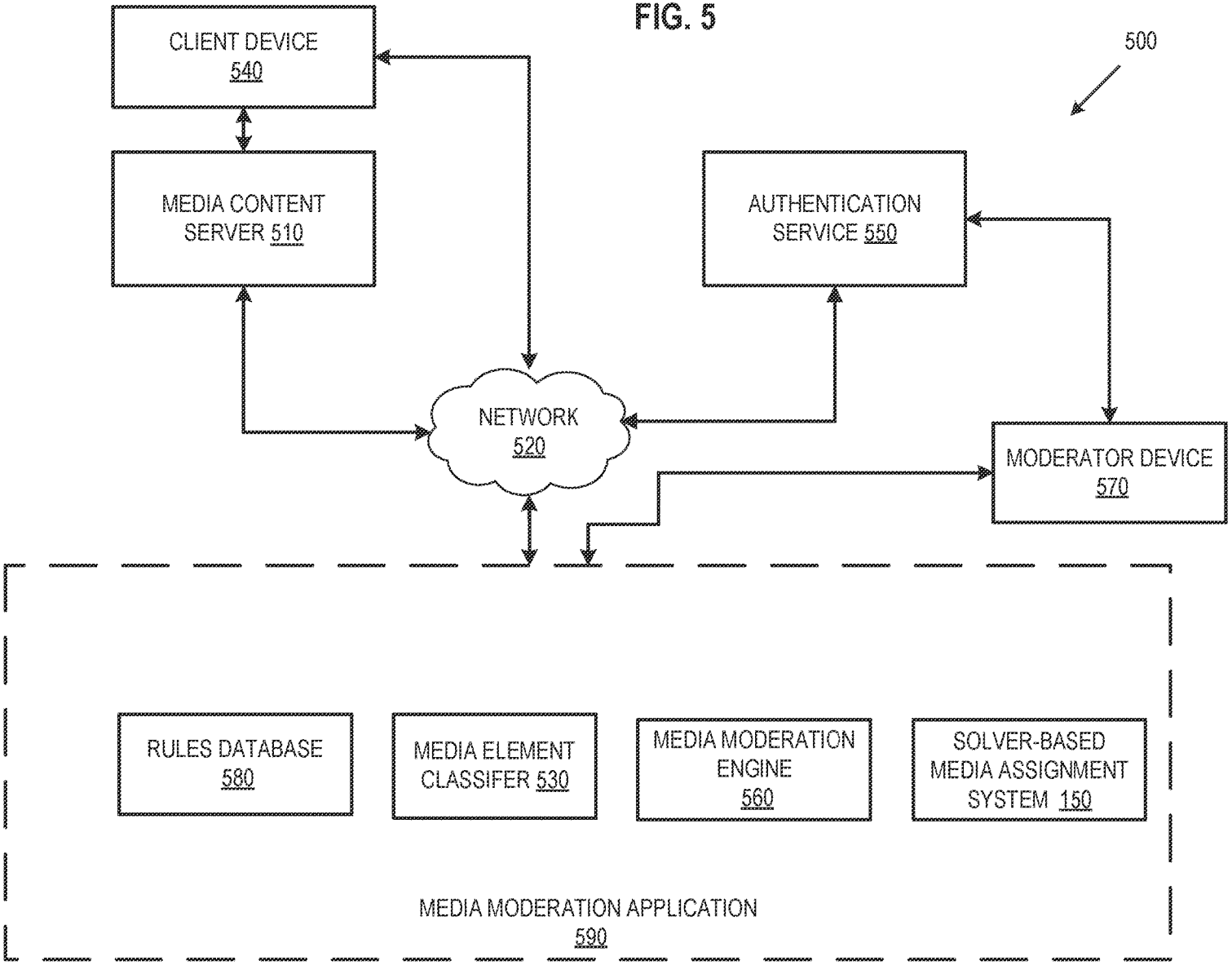
FIG. 5 is another example of inter-component flows for solver-based media assignment in accordance with some embodiments of the present disclosure.

FIG. 5 is an example of a media moderation system in accordance with some embodiments of the present disclosure. The media moderation system 500 includes a client device 540, a media content server 510, a network 520, an authentication service 550, a moderator device 570, and a media moderation application 590 that includes a media element classifier 530, a rules database 580, a media moderation engine 560, and solver-based media assignment system 150.

The client device 540 is any computing device, such as a personal computing device, a server, a mobile computing device, or a smart appliance. The client device 540 can present a graphical user interface to a user with access to the media content server 510. The client device 540 can receive input from the user of the client device. The client device 540 can communicate the received input from the user to the media content server 510. The client device 540 can receive media elements from the media content server 510 for presentation to a user. The client device 540 can receive input from the user in response to the presentation of the media elements. In some embodiments, the client device 540 receives a media element feedback metric from the user. The media element feedback metric indicates that a selected media element has a sensitivity level. The media element feedback metric includes a sensitivity category, a severity (e.g., a scale of 1-10), or an urgency factor, for example.

The media content server 510 is one or more computing devices that store media elements and allow access to the stored media. The media content server 510 is a centralized or distributed computing system and stores any type of digital media including images, digital books, audio files, video files, etc. The media content server 510 provides media elements to multiple users with varying access types, including general users, administrative role users, and moderators.

The network 520 is implemented on any medium or mechanism that provides for the exchange of data, signals, and/or instructions between the various components of media moderation system 500. Examples of network 520 include a LAN, a WAN, an Ethernet network, an Internet Protocol (IP), Transmission Control Protocol (TCP), a satellite or wireless link, or a combination of any number of different networks and/or communication links.

The authentication service 550 is one or more computing devices that validate client devices, moderator devices, or users of the client devices or moderator devices. The authentication service 550 generates one or more credentials, such as a cryptographic key used to access the media content server 510, media moderation engine 560, or media element classifier 530.

The media moderation application 590 includes multiple software applications, including the media element classifier 530 and media moderation engine 560. The illustrated implementation of media moderation application 590 includes a rules database 580 and the solver-based media assignment system 150.

The media element classifier 530 is a trained machine learning model that classifies media elements into one or more categories. The media element classifier 530 classifies the media elements based on, for example, a type of file, a size of the file, an extraction of text (e.g., text recognition in the image or caption information), or a profile of a user who posted the media element. In some embodiments, the media element classifier 530 undergoes a retraining process to include feedback from one or more moderator into the machine learning model.

For instance, the media element classifier 530 determines an initial category of the media element. The media moderation application 590 assigns the media element to a moderator. The media element classifier 530 receives category information from the moderator during the moderation task in which the moderator reviews the assigned media element. The media element classifier 530 adjusts one or more of the parameters of the trained machine learning model based on a comparison of the initially assigned category and the category information received from the moderator.

The rules database 580 includes one or more decision-making rules that may be pre-determined as required rules or preferred rules. In some examples, the rules database 580 is updated by an administrative role user (e.g., a software developer) or based on feedback from the media moderation engine 560 (i.e., a learned rule) or based on feedback received from a moderator.

The media moderation engine 560 includes one or more software applications executed on the media moderation application 590. The media moderation engine 560 is configured to perform one or more of the operations described above with respect to FIG. 4.

The moderator device 570 is a client device that has a specific authentication credential. The moderator device 570 receives the specific authentication credential from the media moderation application 590 or the authentication service 550. For example, the authentication credential may be provisioned by the media moderation application 590 or the authentication service 550.

Figure 6:
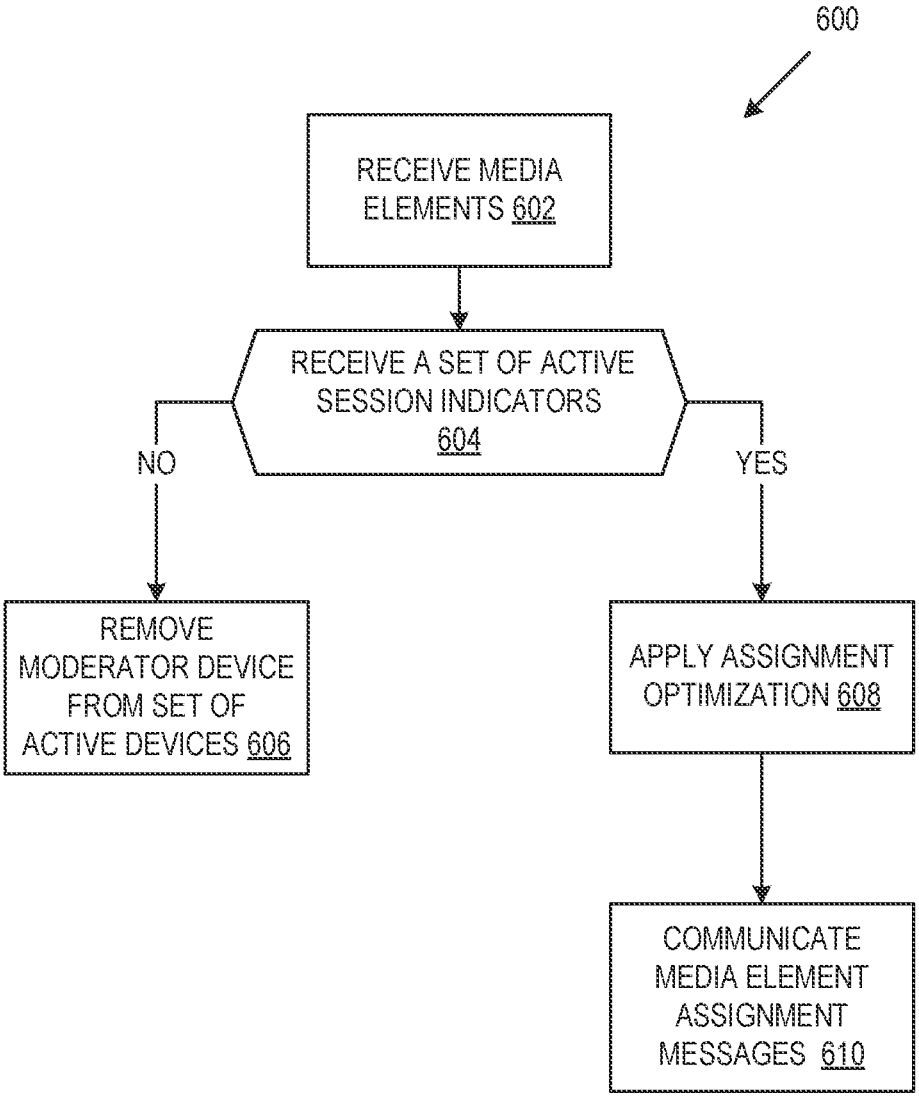
FIG. 6 is a flow diagram of an example method for solver-based media assignment in accordance with some embodiments of the present disclosure.

FIG. 6 is a flow diagram of an example method 600 of media element assignment, in accordance with some embodiments of the present disclosure. The method 600 is performed by processing logic that includes hardware (e.g., processing device, circuitry, dedicated logic, programmable logic, microcode, hardware of a device, integrated circuit, etc.), software (e.g., instructions run or executed on a processing device), or a combination thereof. In some embodiments, the method 600 is performed by the solver-based media assignment system 150 of FIG. 1. Although shown in a particular sequence or order, unless otherwise specified, the order of the processes can be modified. Thus, the illustrated embodiments should be understood only as examples, and the illustrated processes can be performed in a different order, and some processes can be performed in parallel. Additionally, one or more processes can be omitted in various embodiments. Thus, not all processes are required in every embodiment. Other process flows are possible.

At operation 602, the processing device performs the operation of receiving media elements. The processing device receives media elements from the application software system via any communicative coupling mechanisms include network interfaces, inter-process communication (IPC) interfaces and application program interfaces (APIs).

At operation 604, the processing device performs the operation of receiving a set of active session indicators. The processing device communicates, via a networking interface, with multiple different moderator devices. The processing device receives, via the networking interface and from the application software system, an indication of an activity status for each moderator.

At operation 608, the processing device performs the operation of applying assignment optimization to the received media elements and the set of moderators with active sessions. The processing device generates a set of assignable moderators from the multiple moderator devices based on the availability data associated with a moderator. For each assignable moderator, the processing device obtains attribute data obtained from the moderator profile. The processing device compares the element attributes of the received media elements with the moderator attribute data from the moderator profiles. The processing device determines a match between one or more media elements and one or more moderators. In one example, the processing device computes a similarity score between a media element and a moderator.

At operation 610, the processing device performs the operation of communicating media element assignment messages. The processing device transmits assignment messages to the application software system or directly to moderator devices via any communicative coupling mechanisms include network interfaces, inter-process communication (IPC) interfaces and application program interfaces (APIs).

At operation 606, if an active session indicator has not been received for a moderator device, the processing device performs the operation of removing the moderator device from the set of active devices. The processing device removes an inactive moderator device from the set of active devices based on an inactivity of a moderator over a time interval between assignment and moderation task completion. In some embodiments, the processing device generates a prompt with a required response time interval for an active moderator that has not responded within a portion of the time interval for inactivity.

FIG. 7 is a prior art example of a user interface that applies a manual moderation task assignment process. The user interface 700 presents media element data and pending moderation tasks in a tabular form. For example, the user interface 700 indicates a number of moderation tasks and a required completion time. The content source may be selectable by a manual interaction between the moderator and the user interface 700.

Figure 8:
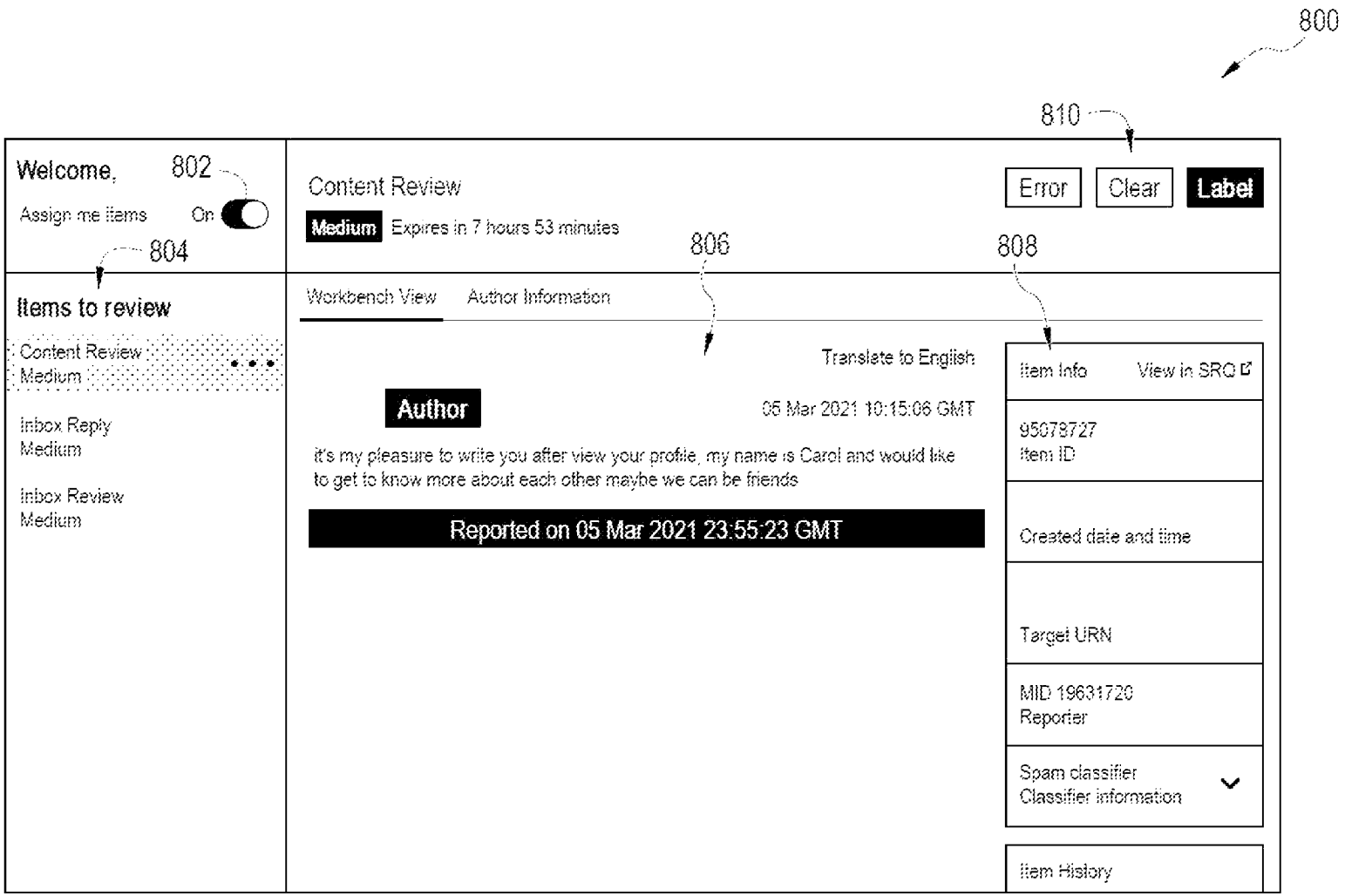
FIG. 8 is an example of a user interface for solver-based media assignment in accordance with some embodiments of the present disclosure.

FIG. 8 is an example of a user interface for media assignments in accordance with some embodiments of the present disclosure. The user interface 800 includes an availability selector 802, a moderation queue 804, a moderation task panel 806, a media element panel 808, and an action panel 810. For example, a moderator accesses the media moderation application using the user interface 800 and toggles the availability selector 802 to an active position (as depicted "On" in FIG. 8). In response to the moderator moving the availability selector 802 to the "On" position, the media moderation application communicates assignment messages to user interface 800 as described previously and the user interface 800 presents those assignments in moderation queue 804. In other words, no items appear in the moderation queue 804 until/unless the moderator changes the position of the availability selector 802 to "On." If the availability selector 802 is not in the "On" position, no task assignments appear in the queue 804. In some embodiments, the solver-based assignment technologies are initiated for a particular user when the user's availability selector 802 is in the "On" position. That is, the media assignment system determines the list of available moderators at a given time by determining which moderators have selector 802 in the "On" position in user interface 800 at that time.

The user/moderator selects a task (e.g., the top task) for completion. In response to the user selecting a task from queue 804, the user interface 800 displays the selected moderation task in moderation task panel 806. The user interface 800 presents additional data associated with the media element in media element panel 808. The user interface 800 prompts the moderator to select an action from action panel 810. The user interface 800 updates in response to the moderator selecting an action from action panel 810 by adjusting the moderation queue 804, updating the moderation task panel 806, the media element panel 808 to reflect as task completion of the first moderation task.

Figure 9:
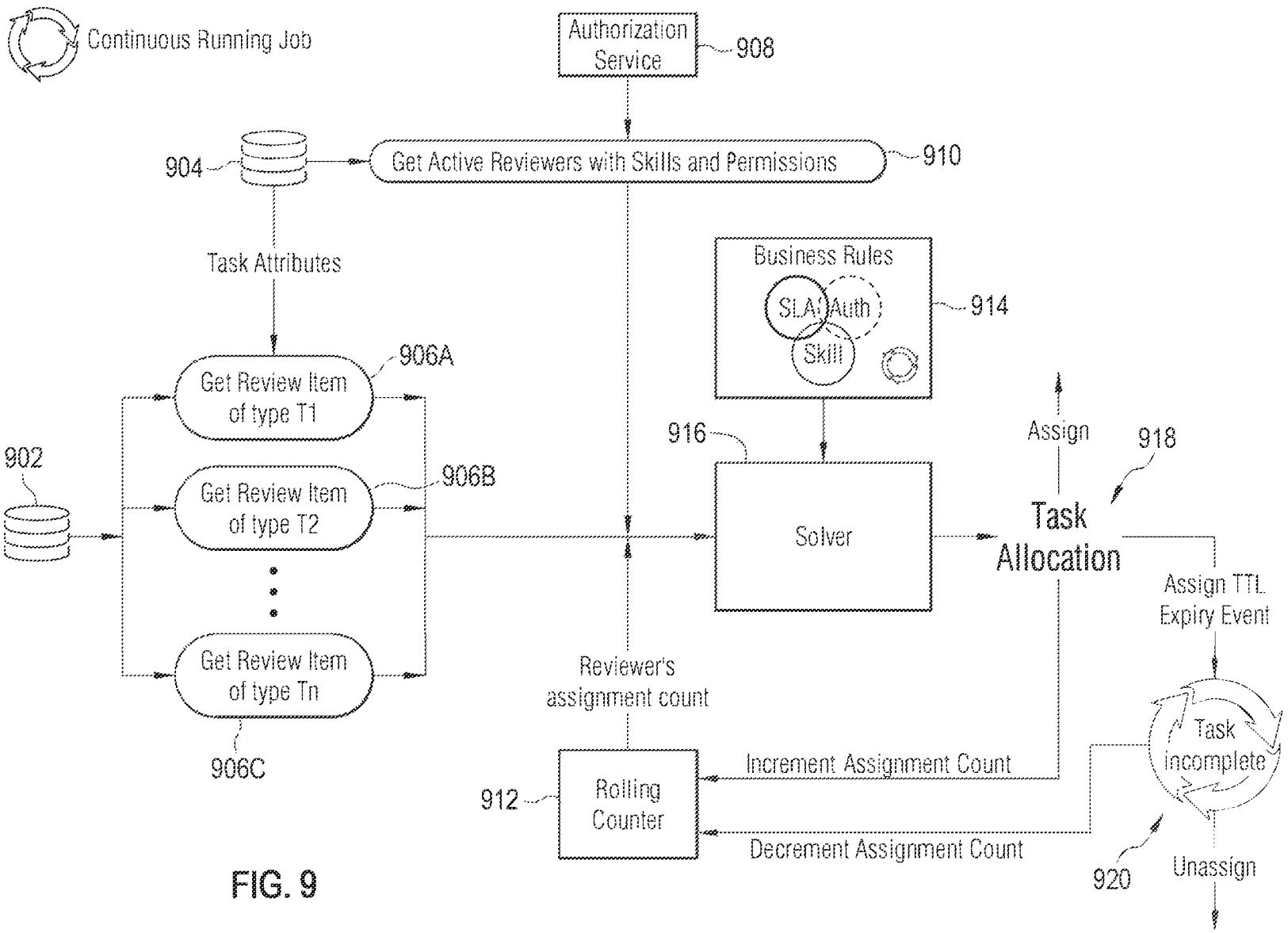
FIG. 9 is an example of a solver-based media assignment system in accordance with some embodiments of the present disclosure.

FIG. 9 illustrates an example of an assignment process for a solver-based media assignment system in accordance with some embodiments of the present disclosure. The solver-based media assignment system of FIG. 9 includes a content database 902, a task database 904, review items 906A-C, authorization service 908, a business rule database 914, solver 916, and rolling counter 912.

The content database 902 stores content (e.g., media items) that has been ingested for a moderation task. The solver-based media assignment system receives these content items and generates a set of review items 906A-C.

The task database 904 contains a set of task attributes which are associated with types of content moderation tasks. For example, a type of task can include a moderation task. A task type can be associated with multiple different task attributes. Examples of task attributes include a language skill, a content permission, and a location.

The authorization service 908 receives an authentication credential from a moderator, such as a username/password, a token value, a biometric, or other known authentication credentials. The authorization service 908 generates a list of authenticated moderators that represents a set of active moderators. The solver-based media assignment system queries the authorization service 908 and generates a list of active moderators 910 and associated moderator profiles. The solver-based media assignment system performs a matching between tasks of task database 904 and active moderator skills and permissions.

The solver-based media assignment system provides the set of review items 906A-C and the set of active moderators to the solver 916 to generate a set of task assignments for a given set of moderators. The solver-based media assignment system provides the list of active moderators 910, the set of review items, and a moderator assignment count as inputs to the solver 916. The solver 916 accesses a business rules database 914. As described above, the business rules database includes a set of required rules, a set of preferred rules, and other requirements. The solver 916 generates a task allocation 918 for each moderator from the list of active moderators 910, the set of review items, the moderator assignment count, and the business rules as described above.

Rolling counter 912 counts and preserves a time interval for each assignment event (task allocation). The rolling window is expressed relative to the task assignment event date and automatically shifts forward by an amount that corresponds to a passage of time.

The continuous running job 920 includes a monitor that monitors a completion status for each task assigned to each moderator. The monitor assigns a time-to-live (TTL) for each task that corresponds to the service level agreement for that task. The monitor monitors the task status and determines an incomplete status at the expiration of the TTL if the task status is incomplete. The monitor unassigns the task from the currently assigned moderator at the expiration of the TTL if the task status is incomplete. The monitor decrements the rolling counter associated with the moderator for which the task was unassigned. The monitor flags the task for reassignment by the solver 916.

FIG. 10 illustrates an example machine of a computer system 1000 within which a set of instructions, for causing the machine to perform any one or more of the methodologies discussed herein, can be executed. In some embodiments, the computer system 1000 can correspond to a component of a networked computer system (e.g., the computing system 100 of FIG. 1) that includes, is coupled to, or utilizes a machine to execute an operating system to perform operations corresponding to the solver-based media assignment system 150 of FIG. 1.

The machine can be connected (e.g., networked) to other machines in a local area network (LAN), an intranet, an extranet, and/or the Internet. The machine can operate in the capacity of a server or a client machine in a client-server network environment, as a peer machine in a peer-to-peer (or distributed) network environment, or as a server or a client machine in a cloud computing infrastructure or environment.

The machine can be a personal computer (PC), a smart phone, a tablet PC, a set-top box (STB), a Personal Digital Assistant (PDA), a cellular telephone, a web appliance, a server, or any machine capable of executing a set of instructions (sequential or otherwise) that specify actions to be taken by that machine. Further, while a single machine is illustrated, the term "machine" shall also be taken to include any collection of machines that individually or jointly execute a set (or multiple sets) of instructions to perform any one or more of the methodologies discussed herein.

The example computer system 1000 includes a processing device 1002, a main memory 1004 (e.g., read-only memory (ROM), flash memory, dynamic random-access memory (DRAM) such as synchronous DRAM (SDRAM) or Rambus DRAM (RDRAM), etc.), a memory 1006 (e.g., flash memory, static random-access memory (SRAM), etc.), an input/output system 'Z10, and a data storage system 1040, which communicate with each other via a bus 1030.

The main memory 1004 is configured to store instructions 1014 for performing the operations and steps discussed herein. Instructions 1014 include portions of solver-based media assignment system 150 when those portions of solver-based media assignment system 150 are stored in main memory 1004. Thus, solver-based media assignment system 150 is shown in dashed lines as part of instructions 1014 to illustrate that portions of solver-based media assignment system 150 can be stored in main memory 1004. However, it is not required that solver-based media assignment system 150 be embodied entirely in instructions 1014 at any given time and portions of activity feature generation system 150 can be stored in other components of computer system 1000.

Processing device 1002 represents one or more general-purpose processing devices such as a microprocessor, a central processing unit, or the like. More particularly, the processing device can be a complex instruction set computing (CISC) microprocessor, reduced instruction set computing (RISC) microprocessor, very long instruction word (VLIW) microprocessor, or a processor implementing other instruction sets, or processors implementing a combination of instruction sets. Processing device 1002 can also be one or more special-purpose processing devices such as an application specific integrated circuit (ASIC), a field programmable gate array (FPGA), a digital signal processor (DSP), network processor, or the like. The processing device 1002 is configured to execute instructions 1012 for performing the operations and steps discussed herein.

Instructions 1012 include portions of solver-based media assignment system 150 when those portions of solver-based media assignment system 150 are being executed by processing device 1002. Thus, similar to the description above, solver-based media assignment system 150 is shown in dashed lines as part of instructions 1012 to illustrate that, at times, portions of solver-based media assignment system 150 are executed by processing device 1002. For example, when at least some portion of solver-based media assignment system 150 is embodied in instructions to cause processing device 1002 to perform the method(s) described above, some of those instructions can be read into processing device 1002 (e.g., into an internal cache or other memory) from main memory 1004 and/or data storage system 1040. However, it is not required that all of solver-based media assignment system 150 be included in instructions 1012 at the same time and portions of activity feature generation system 150 are stored in one or more other components of computer system 1000 at other times, e.g., when one or more portions of solver-based media assignment system 150 are not being executed by processing device 1002.

The computer system 1000 can further include a network interface device 1008 to communicate over the network 1020. Network interface device 1008 can provide a two-way data communication coupling to a network. For example, network interface device 1008 can be an integrated-services digital network (ISDN) card, cable modem, satellite modem, or a modem to provide a data communication connection to a corresponding type of telephone line. As another example, network interface device 1008 can be a local area network (LAN) card to provide a data communication connection to a compatible LAN. Wireless links can also be implemented. In any such implementation network interface device 1008 can send and receive electrical, electromagnetic, or optical signals that carry digital data streams representing various types of information.

The network link can provide data communication through at least one network to other data devices. For example, a network link can provide a connection to the world-wide packet data communication network commonly referred to as the "Internet," for example through a local network to a host computer or to data equipment operated by an Internet Service Provider (ISP). Local networks and the Internet use electrical, electromagnetic, or optical signals that carry digital data to and from computer system 1000.

Computer system 1000 can send messages and receive data, including program code, through the network(s) and network interface device 1008. In the Internet example, a server can transmit a requested code for an application program through the network interface device 1008. The received code can be executed by processing device 1002 as it is received, and/or stored in data storage system 1040, or other non-volatile storage for later execution.

The input/output system 1010 can include an output device, such as a display, for example a liquid crystal display (LCD) or a touchscreen display, for displaying information to a computer user, or a speaker, a haptic device, or another form of output device. The input/output system 1010 can include an input device, for example, alphanumeric keys and other keys configured for communicating information and command selections to processing device 1002. An input device can, alternatively or in addition, include a cursor control, such as a mouse, a trackball, or cursor direction keys for communicating direction information and command selections to processing device 1002 and for controlling cursor movement on a display. An input device can, alternatively or in addition, include a microphone, a sensor, or an array of sensors, for communicating sensed information to processing device 1002. Sensed information can include voice commands, audio signals, geographic location information, and/or digital imagery, for example.

The data storage system 1040 can include a machine-readable storage medium 1042 (also known as a computer-readable medium) on which is stored one or more sets of instructions 1044 or software embodying any one or more of the methodologies or functions described herein. The instructions 1044 can also reside, completely or at least partially, within the main memory 1004 and/or within the processing device 1002 during execution thereof by the computer system 1000, the main memory 1004 and the processing device 1002 also constituting machine-readable storage media.

In one embodiment, the instructions 1026 include instructions to implement functionality corresponding to a solver-based media assignment application (e.g., the solver-based media assignment system 150 of FIG. 1). Solver-based media assignment system 150 is shown in dashed lines as part of instructions 1044 to illustrate that, similar to the description above, portions of solver-based media assignment system 150 can be stored in data storage system 1040 alternatively or in addition to being stored within other components of computer system 1000.

Dashed lines are used in FIG. 10 to indicate that it is not required that solver-based media assignment system 150 be embodied entirely in instructions 1012, 1014, and 1044 at the same time. In one example, portions of solver-based media assignment system 150 are embodied in instructions 1044, which are read into main memory 1004 as instructions 1014, and portions of instructions 1014 are read into processing device 1002 as instructions 1012 for execution. In another example, some portions of activity feature generation system 150 are embodied in instructions 1044 while other portions are embodied in instructions 1014 and still other portions are embodied in instructions 1012.

While the machine-readable storage medium 1042 is shown in an example embodiment to be a single medium, the term "machine-readable storage medium" should be taken to include a single medium or multiple media that store the one or more sets of instructions. The term "machine-readable storage medium" shall also be taken to include any medium that is capable of storing or encoding a set of instructions for execution by the machine and that cause the machine to perform any one or more of the methodologies of the present disclosure. The term "machine-readable storage medium" shall accordingly be taken to include, but not be limited to, solid-state memories, optical media, and magnetic media.

Illustrative examples of the technologies disclosed herein are provided below. An embodiment of the technologies may include any of the examples or a combination of the described below.

In an example 1, a method includes executing a job that gathers task data about a plurality of then-currently pending content moderation tasks and moderator data about a plurality of then-currently online moderator devices; applying an optimization solver to the task data and the moderator data; by the optimization solver, generating a mapping of the then-currently online moderator devices to the then-currently pending content moderation tasks; and based on the mapping, distributing content moderation task assignment messages to the then-currently online moderator devices.

An example 2 includes the subject matter of example 1, further including generating the mapping by receiving a plurality of inputs comprising a content type, a moderator profile, a moderator location, and a moderator queue length. An example 3 include the subject matter of example 1 or example 2, the moderator profile including a set of attributes including language proficiency, technical proficiency, availability, and historical moderations. An example 4 including any of examples 1-3, the moderator the moderator queue length including a quantity of items in a pending status and assigned to a moderator, further including the quantity of an item weighted based on a severity metric associated with the item. An example 5 including any of examples 1-4, further including generating, by a machine learning model, the plurality of inputs from a plurality of content items, moderators, and sets of rules. An example 6 including any of examples 1-5, further including executing the job on a variable time interval, where the variable time interval is determined based on a task type or a content type. An example 7 including the subject matter of any of the examples of 1-6, further including determining a completion status of then-currently pending content moderation tasks; identifying, based on the completion status, a selected task of the then-currently pending content moderation tasks has been idle for a time interval that exceeds a threshold; and generating an additional mapping for the selected task.

In an example 8, a method includes receiving a plurality of media elements each having a plurality of media element attributes; determining, by a machine learning model, a type of a media element of the plurality of media elements based on media element attributes of the media element; receiving, by a solver-based assignment system, active session indications from a plurality of moderator devices that are connected to a media moderation application; applying an optimization solver to the plurality of media element attributes and the active session indications, wherein applying the optimization solver includes: generating a set of assignable moderators from the plurality of moderator devices based on an availability associated with a moderator, wherein each moderator has a moderator profile; comparing the media element attributes with the moderator profile; generating an assignment based on the type of the media element and the moderator profile; and communicating, by the solver-based assignment system, assignment messages to the plurality of moderator devices.

An example 9 includes the subject matter of example 8 where determining a type of a first media element includes determining, from a user report, a type of a media element; determining, by a machine learning classifier, the type of the media element; or determining, by a social listening application, the type of the media element. An example 10 including the subject matter of example 8 or example 9, the social listening application extracts a frequency, a rate of growth, and a visibility of a media element from a media content server. An example 11 including any of examples 8-10, the machine learning classifier determines a type of the media element based on a type of file, a size of the file, an extraction of text, or a profile of a user that uploaded the media element to a media content server. An example 12 including any of examples 8-11, the generating an assignment includes determining that the type of the media element is a sensitive media element that has a particular sensitivity category and a severity factor; monitoring, by the media moderation application, a performance metric of a selected moderator, wherein the performance metric comprises a quantity of sensitive media elements assigned to the selected moderator, wherein the quantity is weighted by the severity factor; and preventing assignment of an additional media elements that have a similar sensitivity category to the selected moderator. An example 13 including the subject matter of any of examples 8-12, the moderator profile comprises a set of attributes including language proficiency, technical proficiency, availability, and historical moderations. An example 14 including the subject matter of any of examples 8-13, where comparing the media element attributes with the moderator profile includes extracting one or more features from the media element; determining a set of moderator profile attributes associated with the one or more features; and computing a similarity score based on the set of moderator profile attributes and the one or more features, wherein the similarity score indicates a number of common values between the set of moderator profile attributes and the one or more features.

An example 15 a system includes a memory component; and a processing device, coupled to the memory component, configured to perform operations including determining a type of a media element of a plurality of media elements based on one or more features of the media element; receiving moderation action s from one or more moderators; determine that a moderator is active based on a time interval measured from a most recent moderation action and a current system time that is below an inactivity time threshold; generating a set of assignable moderators based on an availability associated with each moderator of the one or more moderators, wherein each moderator has a moderator profile containing a plurality of attributes; comparing the one or more features of the media element with the plurality of attributes; generating an assignment based on a similarity between the one or more features and the plurality of attributes; and communicating assignment messages to the one or more moderators.

An example 16 including the subject matter of example 15, the determining a type of a first media element including determining, from a user report, the type of the media element; determining, by a machine learning classifier, the type of the media element; or determining, by a social listening application, the type of the media element. An example 17 including the subject matter of example 15 or example 16, the social listening application extracts a frequency, a rate of growth, and a visibility of a media element from a media content server. An example of 18 including the subject matter of any of examples 15-17, further including classifying, by a machine learning model, a type of the media element based on a type of file, a size of the file, an extraction of text, or a profile of a user that uploaded the media element to a media content server. An example of 19 including the subject matter of any of examples 15-18, the generating an assignment including: determining that the type of the media element is a sensitive media element that has a particular sensitivity category and a severity factor; monitoring a performance metric of a selected moderator, wherein the performance metric comprises a quantity of sensitive media elements assigned to the selected moderator, wherein the quantity is weighted by the severity factor; and preventing assignment of an additional media elements that have a similar sensitivity category to the selected moderator. An example 20 including the subject matter of any of examples 15-19, the moderator profile including a set of attributes including language proficiency, technical proficiency, availability, and historical moderations.

Some portions of the preceding detailed descriptions have been presented in terms of algorithms and symbolic representations of operations on data bits within a computer memory. These algorithmic descriptions and representations are the ways used by those skilled in the data processing arts to convey the substance of their work most effectively to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. The present disclosure can refer to the action and processes of a computer system, or similar electronic computing device, that manipulates and transforms data represented as physical (electronic) quantities within the computer system's registers and memories into other data similarly represented as physical quantities within the computer system memories or registers or other such information storage systems.

The present disclosure also relates to an apparatus for performing the operations herein. This apparatus can be specially constructed for the intended purposes, or it can include a general-purpose computer selectively activated or reconfigured by a computer program stored in the computer. For example, a computer system or other data processing system, such as the solver-based media assignment system 150, can carry out the computer-implemented processes in response to its processor executing a computer program (e.g., a sequence of instructions) contained in a memory or other non-transitory machine-readable storage medium. Such a computer program can be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus.

The algorithms and displays presented herein are not inherently related to any particular computer or other apparatus. Various general-purpose systems can be used with programs in accordance with the teachings herein, or it can prove convenient to construct a more specialized apparatus to perform the method. The structure for a variety of these systems will appear as set forth in the description below. In addition, the present disclosure is not described with reference to any particular programming language. It will be appreciated that a variety of programming languages can be used to implement the teachings of the disclosure as described herein.

The present disclosure can be provided as a computer program product, or software, that can include a machine-readable medium having stored thereon instructions, which can be used to program a computer system (or other electronic devices) to perform a process according to the present disclosure. A machine-readable medium includes any mechanism for storing information in a form readable by a machine (e.g., a computer). In some embodiments, a machine-readable (e.g., computer-readable) medium includes a machine (e.g., a computer) readable storage medium such as a read only memory ("ROM"), random access memory ("RAM"), magnetic disk storage media, optical storage media, flash memory components, etc.

In the foregoing specification, embodiments of the disclosure have been described with reference to specific example embodiments thereof. It will be evident that various modifications can be made thereto without departing from the broader spirit and scope of embodiments of the disclosure as set forth in the following claims. The specification and drawings are, accordingly, to be regarded in an illustrative sense rather than a restrictive sense.

What is claimed is:

1. A method comprising:

executing a job that gathers task data about a plurality of then-currently pending content moderation tasks and moderator data about a plurality of then-currently online moderator devices, wherein executing the job comprises monitoring an activity associated with a plurality of currently-online moderators associated with the plurality of then-currently online moderator devices and, based on the monitored activity, generating a set of assignable currently-online moderators from the plurality of currently-online moderators;

applying an optimization solver to the task data and the moderator data;

generating, by a machine learning model, a plurality of inputs from a plurality of content items, moderators, and sets of rules, wherein the plurality of inputs comprise a content type, a moderator profile, a moderator location, and a moderator queue length;

by the optimization solver, based on the task data, the plurality of inputs, and the moderator data, generating a mapping of assignable currently-online moderators to the then-currently pending content moderation tasks;

determining an active moderator status associated with a moderator of the assignable currently-online moderators based on a time interval measured based on a most recent moderation action and a current system time, wherein the time interval is below an inactivity time threshold; and based on the mapping and the active moderator status, distributing content moderation task assignment messages to the assignable currently-online moderators.

2. The method of claim 1, wherein the moderator profile comprises a set of attributes including language proficiency, technical proficiency, availability, and historical moderations.

3. The method of claim 1, wherein the moderator queue length comprises a quantity of items in a pending status and assigned to a moderator, wherein the quantity of an item is weighted based on a severity metric associated with the item.

4. The method of claim 1, wherein the executing a job comprises executing the job on a variable time interval, where the variable time interval is determined based on a task type or a content type.

5. The method of claim 1 further comprising:

determining a completion status of then-currently pending content moderation tasks;

identifying, based on the completion status, a selected task of the then-currently pending content moderation tasks has been idle fora time interval that exceeds a threshold; and generating an additional mapping for the selected task.

6. A method comprising:

receiving a plurality of media elements each having a plurality of media element attributes;

generating, by a first machine learning model, a plurality of inputs from a plurality of content items, moderators, and sets of rules, wherein the plurality of inputs comprise a content type, a moderator profile, a moderator location, and a moderator queue length;

determining, by a second machine learning model, based on the plurality of media element attributes, a type of a media element of the plurality of media elements;

monitoring, by a solver-based assignment system, an activity associated with a plurality of currently-online moderators associated with a plurality of then-currently online moderator devices that are connected to a media moderation application;

determining an active moderator status associated with the plurality of currently-online moderators based on a time interval measured based on a most recent moderation action and a current system time, wherein the time interval is below an inactivity time threshold;

applying an optimization solver to the plurality of media element attributes, the plurality of inputs, and the plurality of then-currently online moderator devices, wherein applying the optimization solver comprises:

generating a set of assignable currently-online moderators based on the plurality of currently-online moderators associated with the active moderator status, wherein an assignable currently-online moderator has the moderator profile;

comparing the plurality of media element attributes with the moderator profile;

for the assignable currently-online moderator, generating an assignment based on the type of the media element and the moderator profile; and communicating, by the solver-based assignment system, an assignment message to the assignable currently-online moderator.

7. The method of claim 6, wherein determining a type of a first media element comprises:

determining, from a user report, a type of a media element;

determining, by a machine learning classifier, the type of the media element; or determining, by a social listening application, the type of the media element.

8. The method of claim 7, wherein the social listening application extracts a frequency, a rate of growth, and a visibility of a media element from a media content server.

9. The method of claim 7, wherein the machine learning classifier determines a type of the media element based on a type of file, a size of the file, an extraction of text, or a profile of a user that uploaded the media element to a media content server.

10. The method of claim 6, wherein generating an assignment comprises:

determining that the type of the media element is a sensitive media element that has a particular sensitivity category and a severity factor;

monitoring, by the media moderation application, a performance metric of a selected moderator, wherein the performance metric comprises a quantity of sensitive media elements assigned to the selected moderator, wherein the quantity is weighted by the severity factor; and preventing assignment of additional media elements that have a similar sensitivity category to the selected moderator.

11. The method of claim 6, wherein the moderator profile comprises a set of attributes including language proficiency, technical proficiency, availability, and historical moderations.

12. The method of claim 6, wherein comparing the plurality of media element attributes with the moderator profile comprises:

extracting one or more features from a media element of the plurality of media elements;

determining a set of moderator profile attributes associated with the one or more features; and computing a similarityscore based on the set of moderator profile attributes and the one or more features, wherein the similarity score indicates a number of common values between the set of moderator profile attributes and the one or more features.

13. A system comprising:

a memory component; and a processing device, coupled to the memory component, configured to perform operations comprising:

generating, by a first machine learning model, a plurality of inputs from a plurality of content items, moderators, and sets of rules, wherein the plurality of inputs comprise a content type, a moderator profile, a moderator location, and a moderator queue length;

determining a type of a media element of a plurality of media elements based on one or more features of the media element;

monitoring an activity associated with one or more then-currently online moderator devices;

receiving moderation actions from one or more currently-online moderators operating the one or more then-currently online moderator devices;

determining an active moderator status associated with a moderator of the one or more currently-online moderators based on a time interval measured based on a most recent moderation action and a current system time, wherein the time interval is below an inactivity time threshold;

based on the active moderator status, generating a set of assignable currently-online moderators comprising at least one assignable currently-online moderatorof the one or more currently-online moderators, wherein the at least one assignable currently-online moderator has a moderator profile comprising a plurality of attributes;

comparing the one or more features of the media element with the plurality of attributes of the moderator profile;

generating an assignment for the at least one assignable currently-online moderator based on the plurality of inputs and a similarity between the one or more features of the media element and the plurality of attributes of the moderator profile; and communicating assignment messages to the at least one assignable currently-online moderator.

14. The system of claim 13, wherein determining a type of a first media element comprises:

determining, from a user report, the type of the media element;

determining, by a machine learning classifier, the type of the media element; or determining, by a social listening application, the type of the media element.

15. The system of claim 14, wherein the social listening application extracts a frequency, a rate of growth, and a visibility of a media element from a media content server.

16. The system of claim 14, the operations further comprising classifying, by a second machine learning model, a type of the media element based on a type of file, a size of the file, an extraction of text, or a profile of a user that uploaded the media element to a media content server.

17. The system of claim 13, wherein generating an assignment comprises:

determining that the type of the media element is a sensitive media element that has a particular sensitivity category and a severity factor;

monitoring a performance metric of a selected moderator, wherein the performance metric comprises a quantity of sensitive media elements assigned to the selected moderator, wherein the quantity is weighted by the severity factor; and preventing assignment of additional media elements that have a similar sensitivity category to the selected moderator.

18. The system of claim 13, wherein the moderator profile comprises a set of attributes including language proficiency, technical proficiency, availability, and historical moderations.

* * * * *